United States Patent [19]

Kwan et al.

[11] Patent Number: 5,000,005

[45] Date of Patent: Mar. 19, 1991

[54] COMBUSTION CHAMBER FOR A GAS TURBINE ENGINE

[75] Inventors: William C. Kwan; Anthony Pidcock, both of Derby, England

[73] Assignee: Rolls-Royce, Plc, London, England

[21] Appl. No.: 374,837

[22] Filed: Jul. 3, 1989

[30] Foreign Application Priority Data

Aug. 17, 1988 [GB] United Kingdom ..... 8819537

[51] Int. Cl.[5] ..... F23R 3/06

[52] U.S. Cl. ..... 060/757; 431/352

[58] Field of Search ..... 60/757, 755, 754, 756; 431/351, 352

[56] References Cited

U.S. PATENT DOCUMENTS

| | | | |
|---|---|---|---|
| 2,447,482 | 8/1948 | Arnold | 60/754 |
| 2,658,337 | 4/1953 | Clarke et al. | 60/757 |
| 2,785,878 | 3/1957 | Conrad | 60/757 |
| 3,303,645 | 2/1967 | Ishibashi | 60/755 |
| 3,420,058 | 1/1969 | Howald et al. | 60/757 |
| 3,737,152 | 6/1973 | Wilson | 60/757 |
| 4,422,300 | 12/1983 | Dierberger et al. | 60/757 |
| 4,566,280 | 1/1986 | Burr | 60/757 |
| 4,695,247 | 9/1987 | Enzaki et al. | 60/756 |

FOREIGN PATENT DOCUMENTS

| | | | |
|---|---|---|---|
| 994115 | 8/1976 | Canada | 60/756 |
| 1093515 | 4/1966 | United Kingdom | 60/757 |
| 665155 | 1/1952 | United Kingdom | 60/757 |

*Primary Examiner*—Louis J. Casaregola
*Assistant Examiner*—Timothy S. Thorpe
*Attorney, Agent, or Firm*—Cushman, Darby & Cushman

[57] ABSTRACT

A combustion chamber for a gas turbine engine has a wall which is provided with rows of apertures. The apertures are arranged so that the axes of the apertures form an angle of between 25° and 35° with respect to the inner surface of the wall. The apertures have a first cylindircal portion and a second divergent portion to produce fan shaped apertures. An upstream portion of the wall has apertures arranged in axially spaced groups, each of which has three rows of apertures and a downstream portion of the wall has apertures arranged in axially spaced groups, each of which has two rows of apertures. The axes of adjacent apertures in each row are spaced apart by at least three times the diameter of the cylindrical portion. The apertures produce effective film cooling of the wall using less cooling air than conventional cooling rings. The apertures may be arranged locally to cope with hot spots.

17 Claims, 4 Drawing Sheets

COMBUSTION CHAMBER FOR A GAS TURBINE ENGINE

FIELD OF THE INVENTION

The present invention relates to combustion chambers for gas turbine engines, and is particularly concerned with cooling of the walls of the combustion chamber.

BACKGROUND OF THE INVENTION

One conventional method of cooling the walls of combustion chambers of gas turbine engines uses cooling rings which are positioned between and secured to axially spaced wall sections. These cooling rings are provided with a plurality of relatively large apertures arranged in a row, or a number of rows of relatively small apertures. These apertures direct a flow of cooling fluid onto the inner surface of the wall to form a film of cooling fluid which protects the wall from the high temperatures produced in the combustion chamber. However, such cooling rings are relatively wasteful of cooling fluid.

A further problem with the cooling rings is that the thermal gradients produced across the cooling ring lead to cracking of the cooling ring and the large numbers of cooling apertures allows easy propagation of the crack and eventual failure of the cooling ring.

A further conventional method of cooling the wall of combustion chambers of gas turbine engines uses walls which are formed from two or more laminae which are secured together to form internal passages therethrough for transpiration cooling of the wall by a cooling fluid. The cooling fluid is then directed through apertures out of the wall to from a cooling film of fluid on the inner surface of the wall. These arrangements are more efficient than the cooling rings using approximately a third of the cooling fluid, but the inner surface of the wall tends to become relatively hot because of ineffective film cooling due to the apertures being arranged normal to the inner surface and being spaced by relatively large distances.

SUMMARY OF THE INVENTION

The present invention seeks to provide a combustion chamber of a gas turbine with improved film cooling of the walls of the combustion chamber.

Accordingly the present invention provides a combustion chamber for a gas turbine having at least one wall defining at least partially the combustion chamber, the wall having an inner surface and an outer surface, and additionally having at least one row of apertures extending therethrough for supplying cooling fluid onto the inner surface of the wall to form a cooling film of fluid on that surface, the axes of the apertures being arranged to form an angle of between 20° and 40° with the inner surface of the wall, each aperture having a first portion and a second portion, the first portion being arranged to receive cooling fluid from cooling fluid flowing over the outer surface of the wall and to supply the cooling fluid to the second portion, the second portion being divergent and arranged to direct the cooling fluid over the inner surface of the wall to form the cooling film of fluid.

The axes of the apertures may be arranged at an angle of between 25° and 35° with respect to the inner surface of the wall.

The divergent portions of the apertures may be divergent at an angle of substantially 12.5° with respect to the axes of the apertures.

The first portion of the apertures may by cylindrical.

The axes of the adjacent apertures in each row may be spaced apart by at least three times the diameter of the cylindrical portion of the apertures.

The wall may have at least two rows of apertures, the apertures in each row being staggered with respect to the apertures in the adjacent row or rows.

The adjacent rows of apertures may be spaced apart by at least two times the diameter of the cylindrical portion of the apertures.

The cylindrical portion of the apertures may have a diameter of substantially 0.762 mm.

The wall may be an upstream wall of the combustion chamber.

The wall may be a tubular wall of a tubular combustion chamber, or may be an inner annular wall of an annular combustion chamber, or may be an outer annular wall of annular combustion chamber.

An upstream portion of the wall may have the apertures arranged in axially spaced groups, each group having three rows of apertures.

A downstream portion of the wall may have the apertures arranged in axially spaced groups, each group having two rows of apertures.

The present invention will be more fully described by way of example with reference to the accompanying drawings, in which:

DETAILED DESCRIPTION OF THE INVENTION

Figure 1:
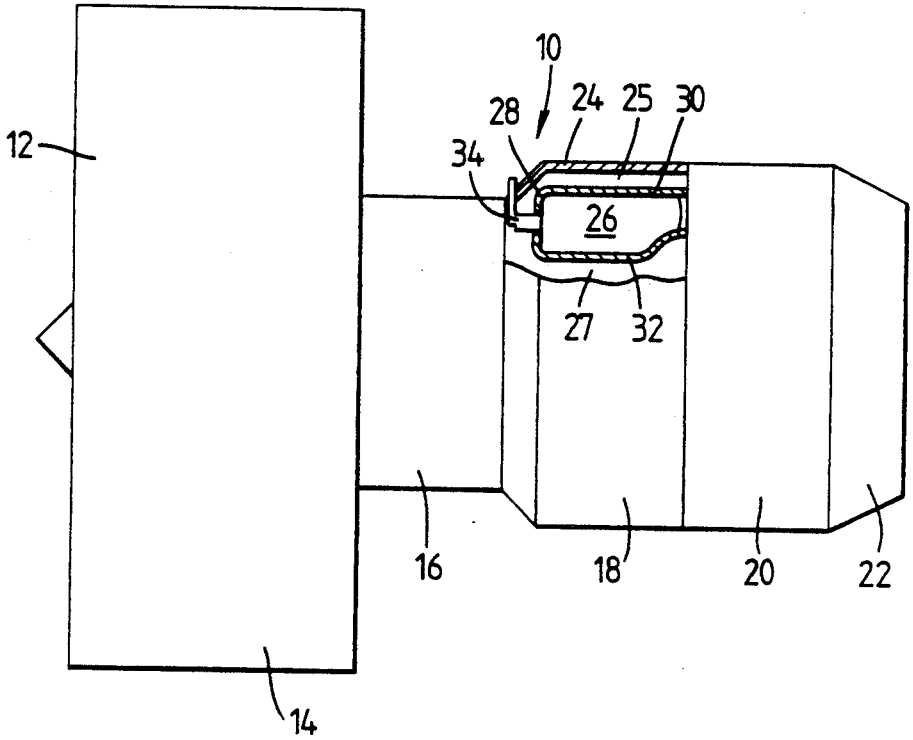
FIG. 1 is partially cut away view of a gas turbine engine showing a combustion chamber according to the present invention.
Figure 2:
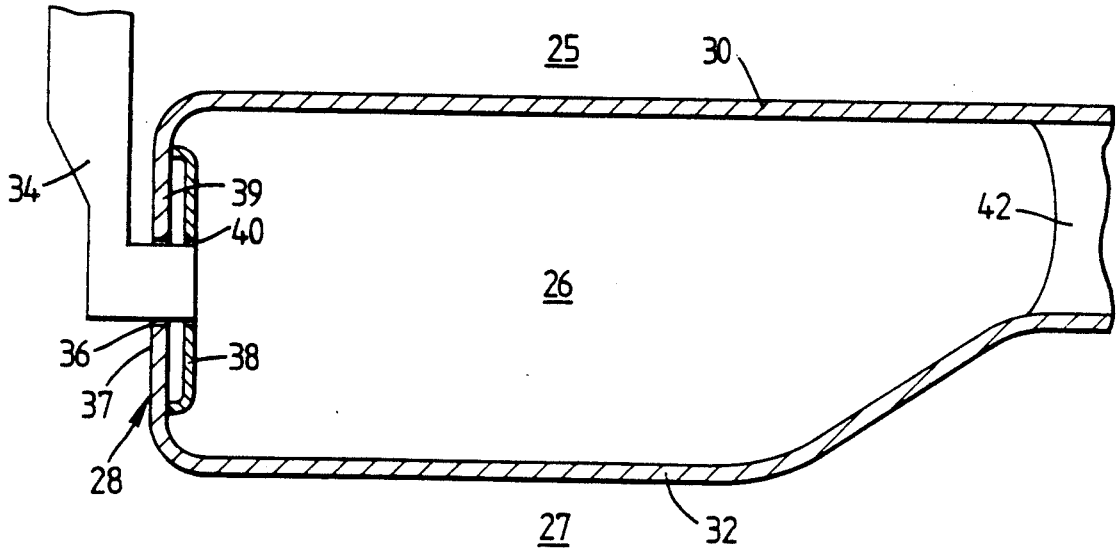
FIG. 2 is an enlarged longitudinal cross-sectional view of the combustion chamber shown in FIG. 1.
Figure 3:
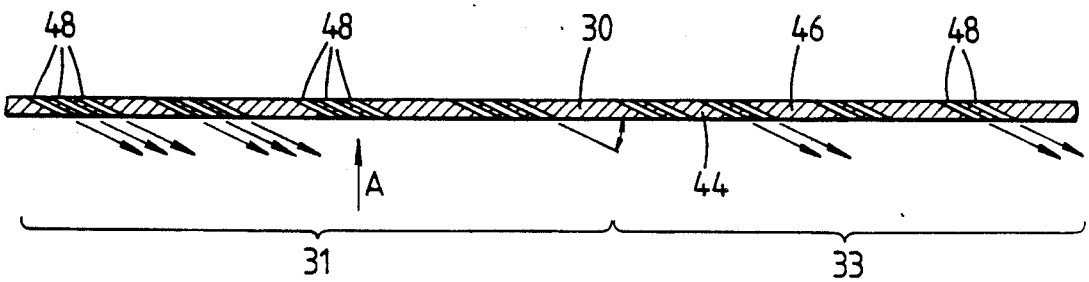
FIG. 3 is an enlarged longitudinal cross-sectional view of an outer annular wall of the combustion chamber shown in FIG. 2.
Figure 4:
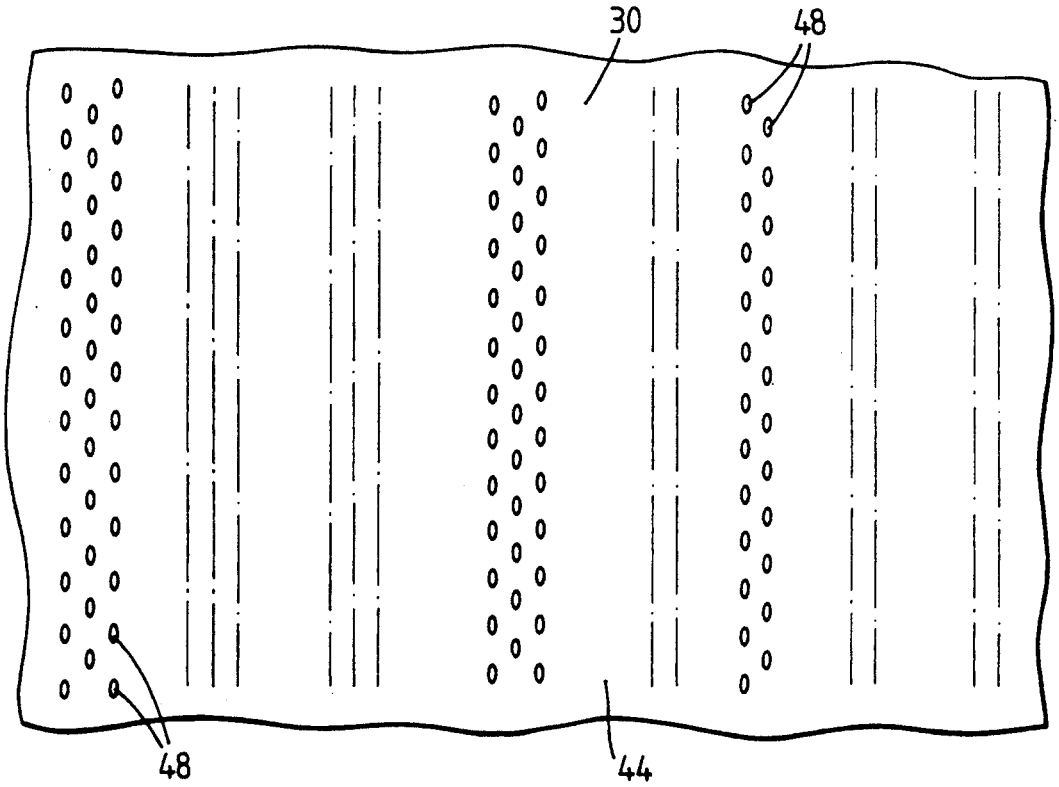
FIG. 4 is a view in the direction of arrow A in FIG. 3.
Figure 5:
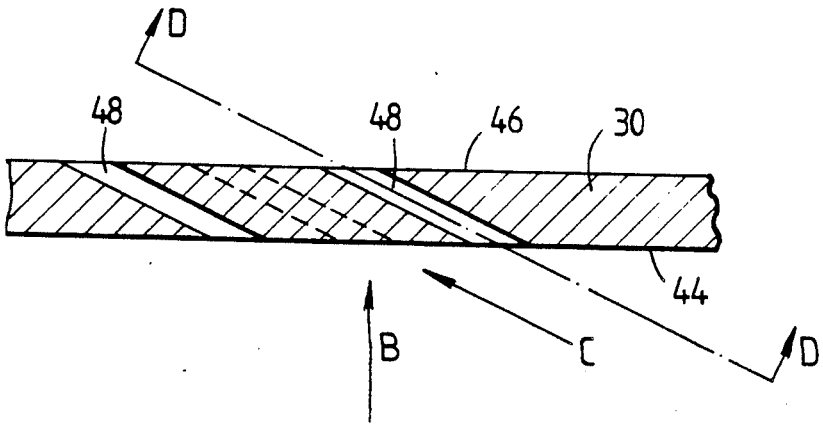
FIG. 5 is an enlarged longitudinal cross-sectional view of a portion of the outer annular wall shown in FIG. 3.
Figure 6:
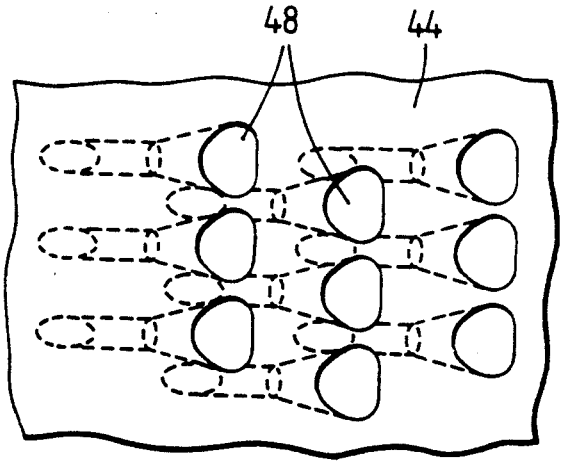
FIG. 6 is a view in the direction of arrow B in FIG. 5.
Figure 7:
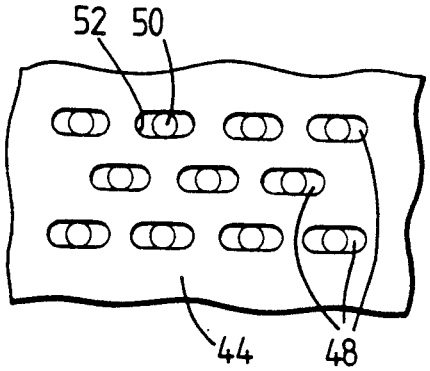
FIG. 7 is a view in the direction of arrow C in FIG. 5.
Figure 8:
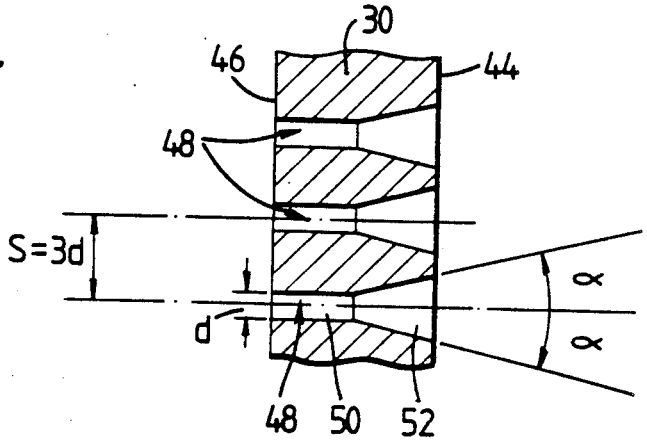
FIG. 8 is a cross-sectional view in the direction of arrows D—D, in FIG. 5.

A turbofan gas turbine engine 10 is shown in FIG. 1, and this comprises in axial flow series an inlet 12, a fan section 14, a compressor section 16, a combustor section 18, a turbine section 20 and an exhaust nozzle 22. The operation of the turbofan gas turbine engine 10 is quite conventional in that air flows into the inlet 12 and is given an initial compression by the fan section 14. This air is divided into two portions. The first portion of air is passed through the fan duct (not shown) to the fan nozzle (not shown). The second portion of air supplied to the compressor section 16 where the air is further compressed before being supplied to the combustor section 18. Fuel is burnt in the air supplied to the combustor section 18 to produce hot gases which flow through and drive the turbine section 20 before passing through the exhaust nozzle 22 to atmosphere. The turbine section 20 is arranged to drive the fan section 14 and compressor section 16 via shafts (not shown).

The combustor section 18 is shown more clearly in FIGS. 2 to 10. The combustor section comprises an outer casing 24 and an annular combustion chamber 26 enclosed by the casing 24. The annular combustion chamber 26 is defined by an annular upstream wall 28, an annular outer wall 30 and an annular inner wall 32. An annular outer passage 25 for the flow of cooling air is formed between the casing 24 and the annular outer wall 30, and an inner passage 27 for the flow of cooling is formed within the annular inner wall 32.

Figure 9:
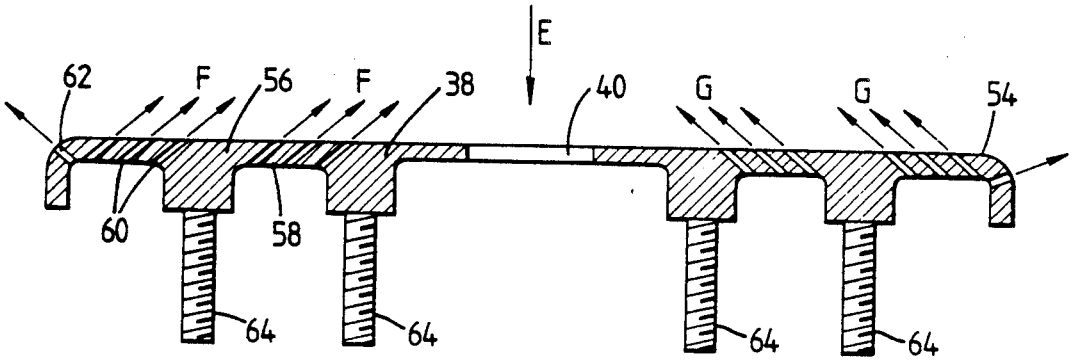
FIG. 9 is an enlarged cross-sectional view through the upstream wall shown in FIG. 2 in a plane perpendicular to the plane of the sheet.
Figure 10:
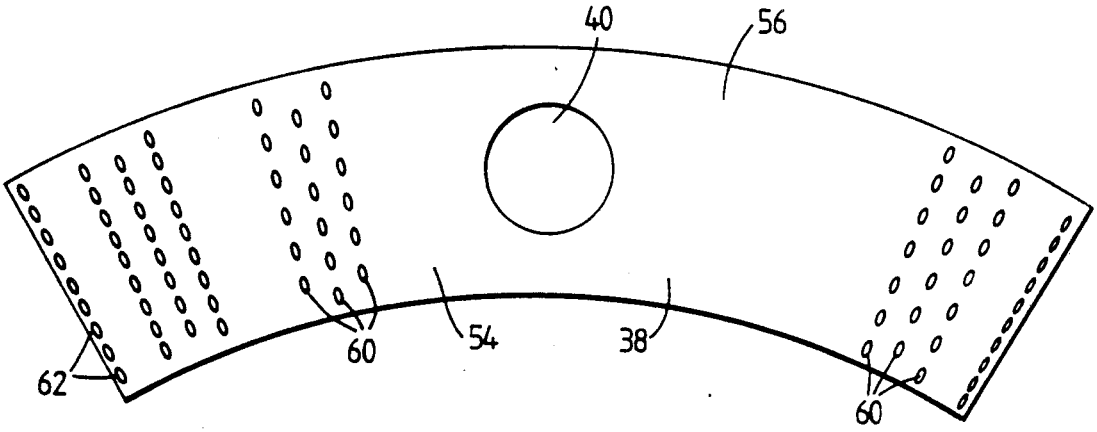
FIG. 10 is a view in the direction of arrow E in FIG. 9.

The annular upstream wall 28 is provided with a plurality of equi-circumferentially spaced apertures 36, and a fuel injector 34 is positioned coaxially in each of the apertures 36. The annular upstream wall 28 comprises an upstream wall member 37 and a downstream wall member 38 with a chamber 39 formed therebetween. The upstream wall member 37 has a plurality of apertures (not shown) for supplying air to the chamber 39. The downstream wall member 38 shown in FIG. 9 and 10 is formed from a plurality of arcuate segments 54 each of which has a central aperture 40 formed substantially in its centre to receive a fuel injector 34. Each segment 54 is secured to the upstream wall member 37 by a number of bolts 64 and nuts (not shown).

The segments 54 of the downstream wall member 38 have an inner surface 56 and an outer surface 58, and the segments 54 are provided with a plurality of rows of apertures 60 extending therethrough which supply cooling air from the chamber 39 onto the inner surface 56 of the segments 64 to form a cooling film of air. The rows of apertures 60 extend radially with respect to the axis of the annular combustion chamber 26. The apertures 60 are arranged so that their axes form an angle of between 20° and 40° with the inner surface 56 of the segments 54. The apertures 60, have first portions which are cylindrical, and second portions which are divergent. The cylindrical portions supply cooling air from the chamber 39 to the divergent portions, and the divergent portions direct the cooling air over the inner surface 56 of the segments 54 to form a cooling film of air. The divergent portions of the apertures diverge at an angle, in this example, of 12.5° with respect to the axes of the apertures. The axes of the adjacent apertures 60 in each row are spaced apart by three times the diameter of the cylindrical portion of the aperture.

It is to be noted that the rows of apertures 60 are arranged in groups of three rows, each group of rows of apertures being angularly spaced from the next group. The apertures in each row are staggered with respect to the apertures in the adjacent row or rows in that group.

The adjacent rows of apertures in each group are spaced apart by at least two times the diameter of the cylindrical portion of the apertures.

There are two groups of three rows of apertures 60 on one circumferential half of the segment 54, and another two groups of three rows of apertures 60 on the other circumferential half of the segment 54, these groups of apertures 60 are arranged to direct the cooling air in a circumferential direction towards the central aperture 40.

The outer annular wall 30 shown in FIGS. 3 to 8 has an inner surface 44 and an outer surface 46, and has a plurality of rows of apertures 48. The apertures 48 extend through the outer annular wall 30 to supply cooling air from the outer annular passage 25 onto the inner surface 44 of the outer annular wall 30 to form a cooling film of air. The rows of apertures 48 extend circumferentially with respect to the axis of the annular combustion chamber 26. The apertures 48 are arranged so that their axes from an angle of between 20° and 40° with respect to the inner surface of the outer annular wall 30. The apertures 48 have first portions 50 which are cylindrical, and second portions 52 which are divergent. The cylindrical portions 50 supply cooling air flowing over the outer surface 46 of the outer annular wall 30 in the outer annular passage 25 to the divergent portions 52, and the divergent portions 52 direct the cooling air in a downstream direction over the inner surface 44 of the outer annular wall 30 to form a cooling film of air. The divergent portions 52 of the apertures 48 diverge at an angle $\alpha = 12.5°$ with respect to the axes of the apertures 48. The axes of the adjacent apertures 48 in each row are spaced apart by a distance S, the distance S is three times the diameter d of the cylindrical portion 50 of the apertures 48. The divergent portions 52 of the apertures 48 diverge in a circumferential direction to produce a fan shaped aperture.

It is to be noted that the rows of apertures 48 are arranged in groups of three rows over an upstream portion 31 of the outer annular wall 30, and are arranged in groups of two rows over a downstream portion 33 of the outer annular wall 30. Each group of three rows of apertures in the upstream portion 31, or each group of two rows of apertures in the downstream portion 33 is axially spaced from the next group. The apertures 48 in each row are staggered with respect to the apertures 48 in the adjacent row or rows in that group.

The adjacent rows of apertures 48 in each group are spaced apart by at least two times the diameter d of the cylindrical portion 50 of the apertures 48.

Preferably the apertures 48 are arranged so that their axes form an angle of between 25° and 35° with respect to the inner surface 44 of the outer annular wall 30.

The cylindrical portions 50 of the apertures 48 in this example have a diameter d of 0.762 mm, and the apertures are formed by laser drilling or other suitable method.

The spacing S, or pitch, between the apertures is the most important dimension, and this is related to the angle of divergence of the apertures. The spacing S between the apertures increases with the angle of divergence of the apertures. In this example the angle $\alpha$ of divergence of the apertures is 12.5°, and the spacing S is three times the diameter d. Apertures having angles $\alpha$ of greater than 12.5° will have a spacing S greater than three times the diameter d.

The apertures are inclined with respect to the inner surface of the upstream wall or annular outer wall so that the cooling air flowing through the apertures forms a cooling film of air on the inner surface of the upstream wall or annular outer wall. Apertures arranged at 90° to the inner surface of the walls do not form cooling films of air because the cooling air does not flow over the inner surface of the wall.

The apertures are divergent to improve the effectiveness of the cooling film of air by reducing the velocity of the air, causing the cooling air to spread out and merge with the cooling air from adjacent apertures in each row, and to ensure the cooling film remains on the inner surface of the walls.

However, with the single row of apertures although the effectiveness of cooling is improved, there is some entrainment of hot gases, produced in the combustion process, between the cooling film of air and the inner surface of the walls.

The use of several closely spaced rows of apertures arranged as a group is particularly beneficial, because the cooling film of air discharged over the inner surface of the wall by the first row of apertures acts as a barrier to inhibit the entrainment of hot gases between the cooling film produced by the second row of apertures and the inner surface of the wall, and likewise the cooling films of air discharged over the inner surface of the wall by the second row of apertures acts as a further barrier to inhibit the entrainment of the hot gases between the cooling film produced by the third row of apertures and the inner surface of the wall. The use of several closely spaced rows of apertures produces a thicker cooling film of air which prevents the hot gases contacting the inner surface of the walls.

The use of walls with cooling apertures as described is more effective than the prior art cooling ring, because it uses a smaller amount of air to cool the same area, the invention uses approximately two thirds of the quantity of cooling air used by the prior art cooling ring.

The annular inner wall may also be provided with rows of apertures similarly arranged to the rows of apertures in the annular outer wall.

The invention although it has been described with reference to an annular combustion chamber may equally well be applied to tubular combustion chambers, or other arrangement of combustion chamber.

The rows of cooling apertures are simple to produce and they may be arranged at any location axial and/or circumferential to cope with local hot spots, ie local arrangements of rows of cooling apertures may positioned to provide film cooling for areas of the combustion chamber which are normally overheated.

The divergent portions of the adjacent apertures in each row are arranged such that the divergent portions do not merge together ie there is a space separating the divergent portions of the adjacent apertures in each row.

We claim:

1. A combustion chamber for a gas turbine engine comprising at least one annular wall defining at least partially the combustion chamber, said combustion chamber having a longitudinal axis, an upstream end and a downstream end, said annular wall having a first, outwardly facing surface, a second inwardly facing surface and a plurality of rows of cooling air apertures extending through said wall with said apertures in each row being spaced apart circumferentially on said wall, each said aperture in each said row having one end on said first surface and an opposite end on said second surface and having a central, longitudinal axis extending from said first to said second surface, each said central longitudinal axis of each aperture intersecting said second surface at an angle of between 20° and 40°, each aperture being oriented to extend generally from said upstream end toward said downstream end of said combustion chamber, each said aperture having a first portion and a second portion, said first portion extending from said one end to a position intermediate said first and second surfaces of said wall, said second portion of each aperture extending from said intermediate position to said opposite end on said second surface of said wall, each said second portion increasing in cross-sectional area as the distance from said intermediate position increases with the dimensional increase being largest in the direction of the circumference of said annular wall.

2. A combustion chamber as claimed in claim 1 in which the axes of the apertures are arranged at an angle of between 25° and 35° with respect to the inner surface of the wall.

3. A combustion chamber as claimed in claim 1 in which the second portions of the apertures are divergent at an angle of substantially 12.5° with respect to the axes of the apertures.

4. A combustion chamber as claimed in claim 3 in which the first portions of the apertures are cylindrical.

5. A combustion chamber as claimed in claim 4 in which the axes of the adjacent apertures in each row are spaced apart by a least three times the diameter of the cylindrical portion of the apertures.

6. A combustion chamber as claimed in claim 1 in which the wall has at least two rows of apertures, the apertures in each row being staggered with respect to the apertures in the adjacent row.

7. A combustion chamber as claimed in claim 4 in which the wall has at least two rows of apertures, the apertures in each row being staggered with respect to the apertures in the adjacent row, the adjacent rows of apertures are spaced apart by at least two times the diameter of the cylindrical portion of the apertures.

8. A combustion chamber as claimed in claim 4 in which the cylindrical portion of the apertures have a diameter of substantially 0.762 mm,

9. A combustion chamber as claimed in claim 1 in which the wall is an upstream wall of the combustion chamber.

10. A combustion chamber as claimed in claim 1 in which the wall is a tubular wall of a tubular combustion chamber.

11. A combustion chamber as claimed in claim 1 in which the wall is an inner annular wall of an annular combustion chamber.

12. A combustion chamber as claimed in claim 1 in which the wall is an outer annular wall of an annular combustion chamber.

13. A combustion chamber as claimed in any of claims 10 to 12 in which the wall has an upstream portion, the upstream portion having the apertures arranged in axially spaced groups, each group having three rows of apertures, the apertures in each row being spaced apart circumferentially.

14. A combustion chamber as claimed in claim 13 in which the wall has a downstream portion, the downstream portion having the apertures arranged in axially spaced groups, each group having two rows of apertures, the apertures in each row being spaced apart circumferentially.

15. A combustion chamber as claimed in claim 1 in which the annular wall is an outer annular wall of an annular combustion chamber, the first surface is the radially outer surface of the outer annular wall and the second surface is the radially inner surface of the outer annular wall.

16. A combustion chamber as claimed in claim 1 in which the annular wall is an inner annular wall of an annular combustion chamber, the first surface is the radially inner surface of the inner annular wall and the second surface is the radially outer surface of the inner annular wall.

17. An annular combustion chamber for a gas turbine engine comprising an annular upstream wall, a radially inner annular wall and a radially outer annular wall, the annular combustion chamber having a longitudinal axis, the annular upstream wall having an upstream surface and a downstream surface, the annular upstream wall having a plurality of rows of cooling air apertures extending therethrough, the apertures in each row being spaced apart radially, each aperture in each said row of apertures having a line interconnecting the center points at each cross-section throughout the length of the aperture, the lines interconnecting the center points of the apertures being arranged to form an angle of between 20° and 40° with the axially downstream surface of the annular upstream wall, each aperture being arranged to extend in a generally circumferential direction through the annular upstream wall from the axially upstream surface to the axially downstream surface, each aperture having a first portion and a second portion, the first portion of each aperture extending from the axially upstream surface of the annular upstream wall to a position intermediate the axially upstream surface and the axially downstream surface, the second portion of each aperture interconnecting with the first portion of the corresponding aperture and extending to the axially downstream surface of the annular upstream wall, each second portion increasing in cross-sectional area towards the axially downstream surface of the annular upstream wall, each second portion increasing in cross-sectional area in a radial direction.

* * * * *